United States Patent [19]

Rishton

[11] 4,425,926

[45] Jan. 17, 1984

[54] INTEGRAL HAIR CLIP AND METHOD OF MANUFACTURE

[76] Inventor: John E. Rishton, 3436 Millbury Ave., Baldwin Park, Calif. 91706

[21] Appl. No.: 313,935

[22] Filed: Oct. 22, 1981

[51] Int. Cl.[3] ..... A45D 8/00

[52] U.S. Cl. ..... 132/46 R

[58] Field of Search ..... 132/46, 48

[56] References Cited

U.S. PATENT DOCUMENTS

Re. 23,163 11/1949 Reiner et al. ..... 132/46 R 2,417,335 3/1947 Westby ..... 132/48 R 3,025,581 3/1962 Duell ..... 132/48 R

*Primary Examiner*—Gregory E. McNeill

*Attorney, Agent, or Firm*—Boniard I. Brown

[57] ABSTRACT

An improved hair clip of unitary construction, which assembles as it is being fabricated by means of a progressive die so that no separate assembly operations are required. The hair clip includes two facing hair engaging jaws on one end, a pair of curved spring portions on the other end and intermediate therebetween a tabbed fulcrum positioned so that an operating handle formed between the spring portions can be pressed to open the jaws.

11 Claims, 6 Drawing Figures

INTEGRAL HAIR CLIP AND METHOD OF MANUFACTURE

BACKGROUND OF THE INVENTION

Hair clips and similar devices to be marketable must work easily and effectively and yet be extremely economical to manufacture as the successful marketing of such devices is highly dependent upon their cost.

Prior art hair clips generally utilize spring elements and dimples to hold the components thereof together and to pivot hair retaining jaws toward each other. Some prior art devices include two to five separate components which must be assembled at relatively high cost. Two thirds of the cost of manufacturing such clips comes from the assembly operation thereof. Some clips, such as are taught in U.S. Pat. No. 3,204,647 to DEKEL and U.S. Pat. No. 3,223,095 to SEEKINGS, et al., are constructed from a single strip of springy sheet metal. However, such are inconvenient to fabricate solely by a progressive die arrangement which could cut the cost of manufacture and otherwise make them more competitive in the marketplace.

BRIEF DESCRIPTION OF THE PRESENT INVENTION

In the present invention a unitary hair clip is described which can be fabricated solely by a progressive die arrangement and therefore requires no assembly operation to manufacture. The present clip is formed by cutting hair retaining jaws on the opposite ends of a strip of spring metal. A handle having a tab slot is cut between what will become the upper jaw of the clip and the lateral center of the strip while a tab member is cut between the lateral centerline and what will become the lower jaw. The handle is then bent generally out of the plane of the strip in one direction while the tab member is bent in the opposite direction. For final fabrication the strip is bent along its lateral centerline so that a shoulder on the tab member engages the handle adjacent the slot with a tab on the tab member extending through the slot. The tab is then bent over to lock the upper and lower jaws together against any residual stress in the spring portion resulting from bending the strip about its lateral centerline. The tab member thereafter works as a fulcrum against the handle so that inward force applied to bend the handle with respect to the upper jaw reverses about the fulcrum to force the jaws apart for insertion of hair therebetween. When the force or the handle is released, the spring portion between the handle and the upper jaw, forces the jaws together about the hair.

As should be apparent, such fabrication can be accomplished by a progressive die arrangement so that the cost of production is greatly reduced when compared to the cost of manufacturing conventional hair clips. The progressive die arrangment can also produce large quantities of hair clips in a relatively short time so that, for example, over one quarter million clips constructed according to the present invention can be fabricated with a single progressive die in a two shift day.

Therefore, it is an object of the present invention to provide a hair clip which can be fabricated at low cost.

Another object is to provide a hair clip which due to its construction does not have a tendancy to undesirably snag the hair of the user.

Another object is to provide a hair clip which is relatively rugged and long lasting and which can be easily manipulated for insertion or removal from the hair.

Another object is to provide a low cost method for manufacturing a hair clip which has no assembly steps separate from its formation steps.

These and other objects and advantages of the present invention will become apparent to those skilled in the art after considering the following detailed specification in conjunction with the accompanying drawing wherein:

DETAILED DESCRIPTION OF THE SHOWN EMBODIMENT

Figure 1:
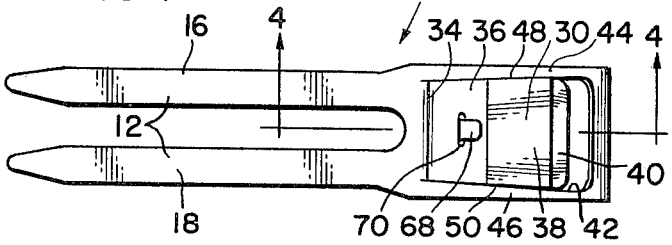
FIG. 1 is a top plan view of a hair clip constructed according to the present invention.
Figure 2:
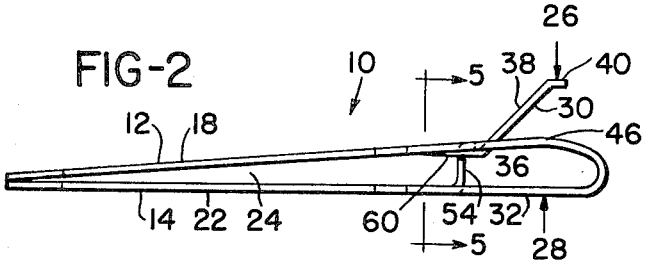
FIG. 2 is a side elevational view of the clip of FIG. 1.
Figure 3:
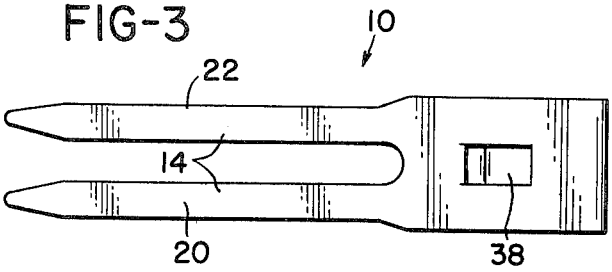
FIG. 3 is an underside plan view of the clip of FIGS. 1 and 2.

Referring to the drawing more particularly by reference numbers, number 10 in FIGS. 1, 2 and 3 refers to a hair clip constructed according to the present invention. The clip 10 includes a pair of hair engaging jaws 12 and 14 with the upper jaw 12 including two prongs 16 and 18 which cooperate with two generally similar prongs 20 and 22 on the lower jaw 14. The jaws 12 and 14 face each other and are provided to retain hair, not shown, in the area 24 therebetween. When it is desired to spread the jaws 12 and 14 to insert hair in the area 24 or remove hair therefrom, manual force is applied to the clip 10 in the direction of the arrows 26 and 28 between a handle 30 and an inner portion 32 of the lower jaw 14.

The handle 30 includes an intersection spring portion 34 integral with the upper jaw 12, a fulcrum portion 36 bent downwardly from the spring portion 34, a lever portion 38 bent upwardly from the fulcrum portion 36, and a handle portion 40 bent generally parallel to the fulcrum portion 36. The handle 30 is formed by cutting it out of the inner portion 42 of the upper jaw 12 with a width always less than the width of the clip 10 so that a pair of U-shaped spring members 44 and 46 remain on the opposite sides 48 and 50 thereof. Since the handle 30 widens toward the handle portion 40 with a generally parallelogram shape, the spring members 44 and 46 narrow as they extend away from the prongs 16 and 18.

Figure 4:
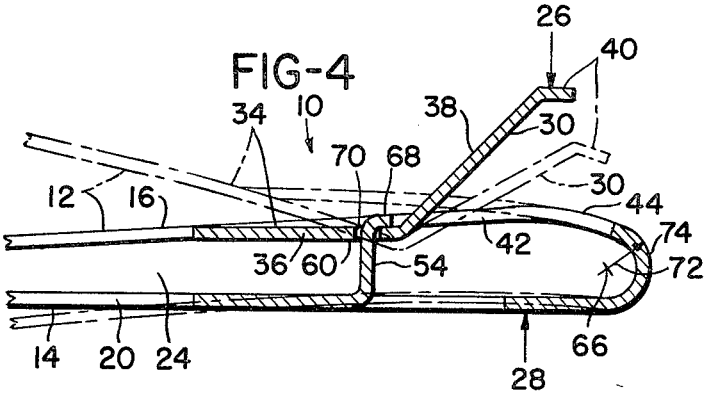
FIG. 4 is an enlarged detail cross-sectional view taken at line 4—4 of FIG. 1.
Figure 5:
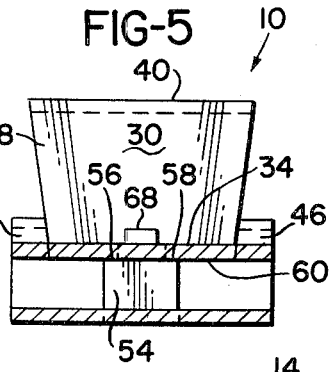
FIG. 5 is an enlarged detail cross-sectional view taken at line 5—5 of FIG. 2.
Figure 6:
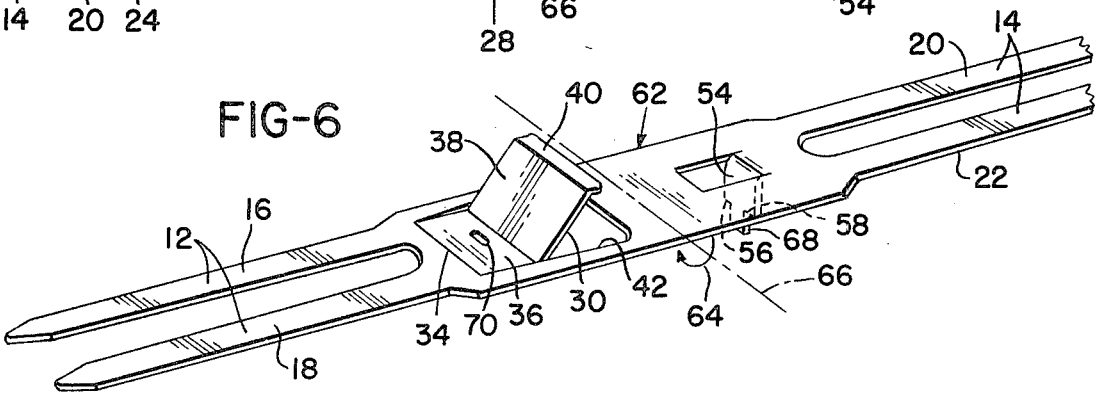
FIG. 6 is a perspective view of a partially formed unitary blank used to fabricate the clip of FIGS. 1 through 5.

The inner portion 32 of the lower jaw 14 includes an upstanding tab member 54 which is cut therefrom and bent to extend toward the fulcrum portion 36 of the handle 30. The tab member 54 shown in detail in FIGS. 4 and 5, includes shoulders 56 and 58 which engage the inward surface 60 of the fulcrum portion 36 as the blank 62 of the clip 10, as shown in FIG. 6, is bent in the direction of arrow 64 about bend line 66. At the same time an outwardly extending tab 68 on the tab member 54 extends through a slot 70 in the fulcrum portion 36. The tab 68 thereafter is bent over, as shown in FIG. 4 to lock the fulcrum portion 36 tightly between the tab 68 and the shoulders 56 and 58. The length of the tab member 54 is chosen with respect to the bend radius 72 of the clip 10 about the bend line 66 so that the jaws 12 and 14 normally held together by the tab 68. The semi-circular spring portion 74 formed about the bend line 64 thereby is therefore prevented from opening by the action of the tab 68 engaged with the fulcrum portion 36. It should be noted from FIG. 4, that the tab 68 is bent over so that little if any clearance results between the shoulders 56 and 58 and the surface 60. This prevents hair from being snagged thereby with its painful consequences.

When it is desired to open the jaws by applying force in the direction of arrows 26 and 28, the force is reacted by the shoulders 56 and 58 to bend the intersection portion 34 and the spring members 44 and 46 so that the jaw 12 moves with respect to jaw 14, as the handle 30 is forced to the position shown in dotted outline in FIG. 4. Since the spring members narrow adjacent the U-shaped spring portion 74 they tend to bend more adjacent the portion 74 than would otherwise occur because of the increase moment arm away from the intersection portion 34. Release of force allows the spring intersection 34 force the spring members 44 and 46 back to the position shown in solid line in FIG. 4, again closing the jaws 12 and 14 for engagement with the hair if any has been positioned therebetween when the jaws 12 and 14 were open.

Therefore there has been shown and described a novel unitary hair clip which fulfills all of the objects and advantages sought therefore. Many changes, modifications, variations and other uses and applications of the subject hair clip will become apparent to those skilled in the art after considering this specification and the accompanying drawing. All such changes, modifications, variations and other uses and applications which do not depart from the spirit and scope of the invention are deemed to be covered by the invention which is limited only by the claims which follow.

What is claimed is:

1. A one piece hair clip formed from a unitary strip of material including:

first hair retaining jaw means;

second hair retaining jaw means facing said first hair retaining jaw means so that hair can be retained therebetween;

spring means connecting said first and second hair retaining jaw means;

a handle portion resiliently connected to said first hair retaining jaw means, said handle portion including:

a first abutment surface; and a discontinuity formed therethrough; and a fulcrum post extending from said second hair retaining jaw means, said fulcrum post having:

a second abutment surface thereon elevated from said second hair retaining jaw means positioned to engage said first abutment surface; and a retainer portion positioned through said discontinuity and formed to retain said first and second abutment surfaces in at least close adjacency.

2. The one piece hair clip as defined in claim 1 wherein said handle portion includes:

an intersection spring portion integral with said first jaw means;

a fulcrum portion being connected to said intersection spring portion, said fulcrum portion having said discontinuity formed therethrough and said first abutment surface positioned thereon;

a lever portion connected to said fulcrum portion opposite from said intersection spring portion; and a handle connected to said lever portion.

3. The one piece hair clip as defined in claim 2 wherein said fulcrum portion is bent toward said second hair retaining jaw means, said lever portion is bent away from said second hair retaining jaw means, and said handle is bent generally parallel to said second hair retaining jaw means.

4. The one piece hair clip as defined in claim 3 wherein said handle portion is formed from a parallelogram cut out of said spring means.

5. The one piece hair clip as defined in claim 1 wherein said spring means stresses said handle portion against said retainer portion.

6. The one piece hair clip as defined in claim 1 wherein said discontinuity is a slot formed through said handle portion, said handle portion including;

a third abutment portion surface positioned adjacent said slot, said retainer portion being a tab which is positioned through said slot and is bent over into contact with said third abutment surface.

7. A method of constructing a one piece hair clip from a flat strip of resilient material including the steps of:

blanking a first hair retaining jaw, a second hair retaining jaw, a handle, a discontinuity through the handle, and a fulcrum post having a retainer portion extending therefrom from the flat strip;

bending the handle generally in a first direction and the fulcrum post in a generally opposite, second direction;

bending the strip into a U shape so that the retainer portion passes through the discontinuity; and bending the retainer portion over the discontinuity.

8. The method as defined in claim 7 wherein the handle includes an intersection spring portion integral with the first jaw means, a fulcrum portion connected to the intersection spring portion and having the discontinuity formed therethrough, a lever portion connected to the fulcrum portion, and a handle portion connected to the lever portion, when the handle is bent the fulcrum portion being bent slightly toward the second direction, the lever portion being bent in the first direction and the handle portion being bent generally parallel to the flat strip.

9. The method as defined in claim 7 wherein the blanking of the fulcrum post retainer portion includes:

blanking a tab as the retainer portion; and blanking shoulders adjacent the tab, the blanking of the handle including:

blanking a slot as the discontinuity, and the bending of the strip into a U shape includes:

the passing of the tab through the slot so that the shoulders are positioned at the handle.

10. The method as defined in claim 7 wherein the bending of the retainer portion over the discontinuity includes:

the bending of a portion of the tab which extends beyond the slot, over the handle adjacent the slot.

11. The method as defined in claim 10 wherein the bending of the strip into a U shape results in residual stress of the handle against the tab.

* * * * *